US007017532B2

(12) United States Patent
Ozaki et al.

(10) Patent No.: US 7,017,532 B2
(45) Date of Patent: Mar. 28, 2006

(54) ENGINE AND PERSONAL WATERCRAFT

(75) Inventors: Atsufumi Ozaki, Kobe (JP); Yasuo Okada, Akashi (JP); Hideaki Ebisui, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/714,024

(22) Filed: Nov. 14, 2003

(65) Prior Publication Data

US 2004/0134451 A1 Jul. 15, 2004

(30) Foreign Application Priority Data

Nov. 15, 2002 (JP) ..... 2002-332037

(51) Int. Cl.
*F02F 1/10* (2006.01)

(52) U.S. Cl. ..... 123/41.72; 440/88 G

(58) Field of Classification Search ..... 123/41.72, 123/41.74, 41.31, 41.08; 440/88 G
See application file for complete search history.

(56) References Cited

U.S. PATENT DOCUMENTS 4,294,203 A * 10/1981 Jones ..... 123/195 R
6,312,300 B1 * 11/2001 Asai ..... 440/88 R
6,752,672 B1 * 6/2004 Kanno ..... 440/84
6,793,546 B1 * 9/2004 Matsuda ..... 440/88 C

FOREIGN PATENT DOCUMENTS

GB 1479139 A * 7/1977
JP HEI. 2-100896 8/1990
JP HEI. 5-32296 4/1993

* cited by examiner

*Primary Examiner*—Henry C. Yuen
*Assistant Examiner*—Hyder Ali
(74) *Attorney, Agent, or Firm*—Alleman Hall McCoy Russell & Tuttle LLP

(57) ABSTRACT

An engine for a personal watercraft uses an open-looped cooling system and comprises a cylinder block having a water jacket within which cooling water flows, and a piston that reciprocates within the cylinder block, and a dimension of the water jacket in a reciprocation direction of the piston is equal to or less than a half of a reciprocation distance of the piston.

18 Claims, 7 Drawing Sheets

ENGINE AND PERSONAL WATERCRAFT

BACKGROUND OF THE INVENTION

1. Field of the Invention

The present invention relates to an engine configured to drive a propulsion mechanism of a watercraft, and a personal watercraft comprising the engine as a drive source of the propulsion mechanism.

2. Description of the Related Art

In recent years, jet-propulsion personal watercraft have been widely used in leisure, sport, rescue activities, and the like. A typical personal watercraft includes an engine mounted in a space within the watercraft that is surrounded by a hull and a deck. The engine is configured to drive a water jet pump, which pressurizes and accelerates water sucked from a water intake generally provided on a hull bottom surface, and ejects it rearward from an outlet port. As the resulting reaction, the personal watercraft is propelled forward.

In a personal watercraft, typically, water (e.g., sea water or lake water) that has been pressurized by the water jet pump is partially drawn from an inside of the water jet pump through a water-drawing hole provided in a pump casing, for use as cooling water to cool various engine components, such as a cylinder head and a cylinder block, as well as auxiliary equipment such as an exhaust device. Such a cooling system is called an open-looped cooling system (or direct cooling system), and is disclosed in Published Unexamined Japanese Utility Model No. H02-100896.

Furthermore, the cylinder head, the exhaust device and the like tend to heat up to relatively high temperatures. In order for these components to be sufficiently cooled, prior open-looped cooling systems include a pump casing with a water-drawing hole having a relatively large diameter, to enable a large amount of water to be drawn up through the water-drawing hole to cool these components. Typically, the cooling water is required to be drawn from a location within the water jet pump where static pressure of the water is stable. Since such a location lies within a relatively narrow region (hereinafter, referred to as a "stable static-pressure region"), large-diameter water-drawing holes of prior open-looped cooling systems tend to extend at least partially outside the stable static-pressure region. This is problematic, because it reduces water-drawing efficiency, making it difficult to take in a large amount of cooling water.

The reduced water-drawing efficiency occurs because the water jet pump is driven in cooperation with rotation of the engine, and the pressure of the water flowing within the pump varies with an engine speed of the engine. Thus, when the water-drawing hole partially extends outside the stable static-pressure region, the cooling water being drawn up significantly decreases with decreasing engine speed.

In contrast to the above described direct cooling system, in prior indirect cooling systems, coolant circulates within an engine while cooling components that generate heat, such as a cylinder block. Heat is exchanged between the coolant and air or water taken in from outside to allow the heat to be released to outside the watercraft. These prior indirect cooling systems must have a cooling water passage with a relatively large heat-release area, for the components to be cooled appropriately. For example, one prior indirect cooling system includes a water jacket provided within the cylinder block designed so that a dimension in a piston stroke direction (piston reciprocation direction) is maximized for the purpose of a larger heat-release area of the cooling water passage.

The cooling water used in prior direct cooling systems employed in personal watercraft is generally lake or sea water, which typically has a temperature lower than that of the coolant used in indirect cooling systems. When a direct cooling system is applied to an engine that also is equipped with an indirect cooling system, the cylinder block is undesirably cooled excessively, thereby causing a friction loss due to friction between the cylinder block and a piston which reciprocates within the cylinder block to increase. By drawing up the water in limited amount, the excess cooling, and hence the increase in the friction loss can be inhibited, but the cylinder head and the exhaust device whose temperatures become high tend to be insufficiently cooled.

The friction loss caused by the excess cooling of the cylinder block occurs in both two-cycle engines and four-cycle engines. In addition to the friction loss, in four-cycle engines, excess cooling causes fuel to be insufficiently vaporized within the combustion chambers. Uncombusted fuel may be undesirably mixed with lubricating oil in the engine, which causes dilution of the oil.

SUMMARY OF THE INVENTION

The present invention addresses the above described conditions, and an object of the present invention is to provide an engine capable of appropriately cooling components whose temperatures tend to become relatively high, such as a cylinder head and an exhaust device, and capable of inhibiting a cylinder block from being excessively cooled, as well as to a personal watercraft comprising such an engine.

According to one aspect of the present invention, there is provided an engine for a personal watercraft having an open-looped cooling system configured to take in water from outside of the watercraft for use as cooling water to cool the engine and thereafter discharge the cooling water outside the watercraft, the engine comprising a cylinder block having a water jacket within which the cooling water flows, and a piston that reciprocates within the cylinder block, wherein a dimension of the water jacket in a reciprocation direction of the piston is equal to or less than a half of a reciprocation distance of the piston.

In accordance with the above construction, in a direct cooling system (open-looped cooling system) using cooling water of a relatively low temperature, the cooling water can be sufficiently supplied to a cylinder head and an exhaust device of the engine, while the cooling water is supplied to the cylinder block in limited amount to allow the cylinder block to be inhibited from being excessively cooled.

The engine for a personal watercraft may further comprise a cylinder head provided on the cylinder block and configured to form a combustion chamber, wherein the water jacket is provided in an end portion of the cylinder block on the cylinder head side so as to surround the piston. Thereby, a portion of the cylinder block on the cylinder head side, which tends to be heated more easily than the other portion of the cylinder block, can be efficiently cooled.

The water jacket configured to open in the end face of the cylinder block on the cylinder head side, can be formed simultaneously when the cylinder block is formed by casting.

The engine for a personal watercraft may further comprise a cylinder head provided on the cylinder block and configured to form a combustion chamber, wherein the cylinder block and the cylinder head are configured to be cooled by cooling water, and the cylinder block is placed downstream of the cylinder head in a flow direction of the cooling water in the cooling system.

By applying the above described structure to a two-cycle engine, increase in a friction loss due to friction between the cylinder block and the piston can be inhibited. Also, by applying the above described structure to a four-cycle engine, occurrence of dilution of the oil as well as the increase in the friction loss, can be inhibited.

According to another aspect of present invention, there is provided a personal watercraft comprising a water jet pump forming a propulsion mechanism of the watercraft, an engine configured to drive the water jet pump, and a cooling system configured to cool the engine with water, wherein the cooling system has at least two water-drawing passages through which the water is drawn from an inside of the water jet pump for use as cooling water.

For example, sea water being drawn from outside often contains unwanted substances such as water borne plants with which the water-drawing passages may become clogged. This causes insufficient circulation of the cooling water. However, in a cooling system having at least two water-drawing passages, if any one of the water-drawing passages is clogged with the substances, the water is drawn through the water-drawing passage that is not clogged with substances.

A plurality of water-drawing holes of the water-drawing passages may be circumferentially arranged on an outer periphery of the water jet pump. A diameter of each of the water-drawing holes through which the water is drawn from the inside of the water jet pump into the water-drawing passages can be made relatively small, the water-drawing holes can be provided appropriately within a narrow static-pressure stable region inside the water jet pump.

The engine may comprise a cylinder block having a water jacket within which the cooling water flows and a piston that reciprocates within the cylinder block, wherein a dimension of the water jacket in a reciprocation direction of the piston is equal to or less than a half of a reciprocation distance of the piston. With this structure, a cylinder head and an exhaust device of the engine can be sufficiently cooled by the cooling water drawn efficiently through the at least two water-drawing passages, while a heat-release area within the cylinder block is made small to allow heat release from the cylinder block to the cooling water to be limited. Thereby, the friction loss, and dilution of the oil in the four-cycle engine, can be inhibited.

The personal watercraft may further comprise an exhaust device of the engine which is configured to be cooled by the cooling water, wherein the engine may have a cylinder block configured to be cooled by the cooling water, and the cylinder block may be placed downstream of the exhaust device in a flow direction of the cooling water in the cooling system. Since the cooling water that has first cooled the exhaust device whose temperature becomes relatively high is introduced to the cylinder block, the exhaust device is sufficiently cooled, while the cylinder block is inhibited from being excessively cooled. As a result, the friction loss, and dilution of the oil in the four-cycle engine, can be inhibited.

The engine of the personal watercraft may have a cylinder block and a cylinder head configured to be cooled by the cooling water, and the cylinder block may be placed downstream of the cylinder head in a flow direction of the cooling water in the cooling system. In this construction, since the cooling water that has first cooled the cylinder head whose temperature becomes relatively high is introduced to the cylinder block, the cylinder head is sufficiently cooled, while the cylinder block is inhibited from being excessively cooled.

The above and further objects and features of the invention will more fully be apparent from the following detailed description with accompanying drawings.

DETAILED DESCRIPTION OF THE PREFERRED EMBODIMENTS

Figure 1:
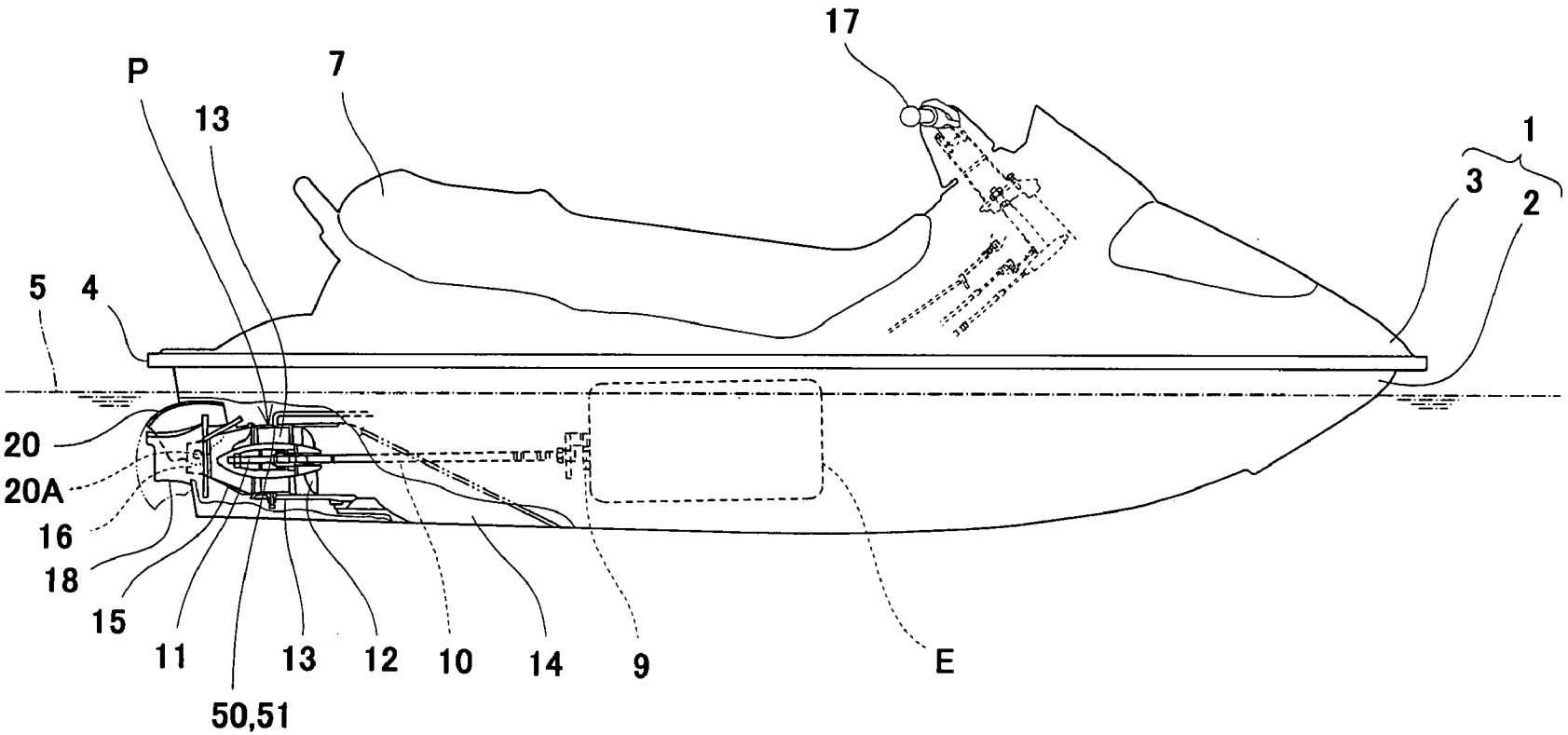
FIG. 1 is a side view of a personal watercraft according to an embodiment of the present invention.

Hereinafter, embodiments of an engine and a personal watercraft of the present invention will be described with reference to the drawings. The personal watercraft in FIG. 1 is a straddle-type personal watercraft provided with a seat 7 straddled by a rider. A body 1 of the watercraft comprises a hull 2 and a deck 3 covering the hull 2 from above. A line at which the hull 2 and the deck 3 are connected over the entire perimeter thereof is called a gunnel line 4. The gunnel line 4 is located above a waterline 5 of the watercraft.

Figure 2:
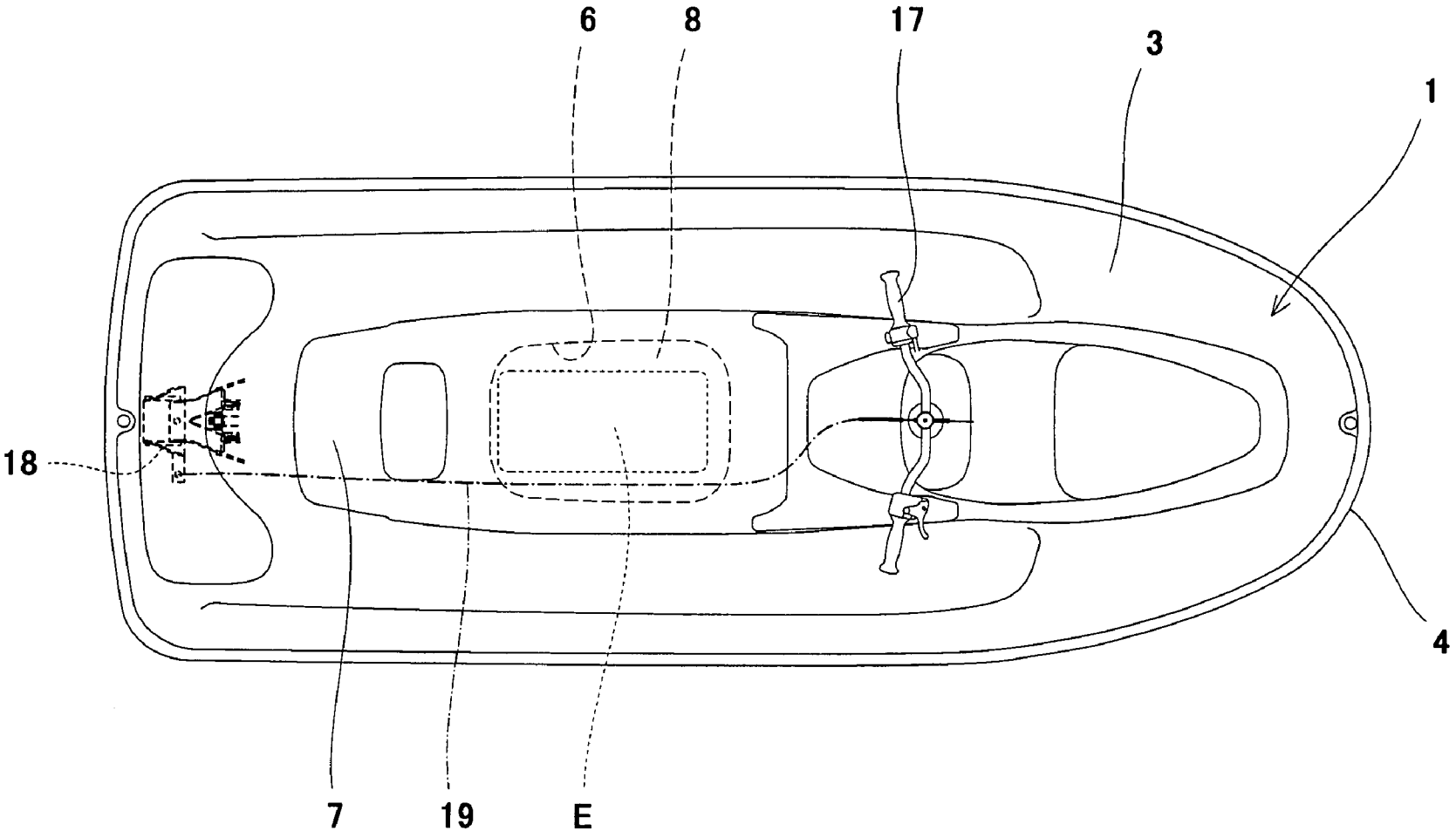
FIG. 2 is a plan view of the personal watercraft in FIG. 1.

As shown in FIG. 2, an opening 6, which has a substantially rectangular shape as seen from above is formed at a substantially center section of the deck 3 in the upper portion of the body 1 such that its longitudinal direction corresponds with the longitudinal direction of the body 1. The seat 7 is removably mounted over the opening 6.

An engine room 8 is provided in a space defined by the hull 2 and the deck 3 below the opening 6. The engine room 8 has a convex-shaped transverse cross-section and is configured such that its upper portion is smaller than its lower portion. An engine E is mounted within the engine room 8 and configured to drive the watercraft. In this embodiment, the engine E is an in-line four-cylinder four-cycle engine, in which the pistons are configured to travel four strokes per cycle in the following order: intake stroke, compression stroke, power stroke and exhaust stroke. As shown in FIG. 1, the engine E is mounted such that a crankshaft 9 extends along the longitudinal direction of the body 1.

An output end of the crankshaft 9 is rotatably coupled integrally with a pump shaft 11 of a water jet pump P provided on the rear side of the body 1 through a propeller shaft 10. An impeller 12 is attached on the pump shaft 11. Fairing vanes 13 are provided behind the impeller 12. The impeller 12 is covered with a substantially cylindrical pump casing 13 on the outer periphery thereof.

A water intake 14 is provided on the bottom of the body 1. The water intake 14 is connected to the pump casing 13 through a water passage. The pump casing 13 is connected to a pump nozzle 15 provided on the rear side of the body 1. The pump nozzle 15 has a cross-sectional area that gradually reduces rearward, and an outlet port 16 is provided on the rear end of the pump nozzle 15.

The water outside the watercraft is sucked from the water intake 14 on the bottom of the hull 2 and fed to the water jet pump P. The water jet pump P pressurizes and accelerates the water, and the fairing vanes 13 guide water flow behind the impeller 12. The water is ejected through the pump nozzle 15 and from the outlet port 16, and, as the resulting reaction, the watercraft obtains a propulsion force.

The engine E employs an open-looped cooling system configured to directly cool the engine E or the like by water taken in from outside for use as cooling water. As shown in FIG. 1, water-drawing holes 50 and 51 are provided at predetermined locations on an upper portion of the pump casing 13. Some of the water pressurized by the water jet pump P is drawn into the cooling system within the watercraft through the water-drawing holes 50 and 51. The cooling water is supplied to the engine E and auxiliary equipment through the cooling system to cool these components. The cooling system will be described in detail later.

A bar-type steering handle 17 is provided forward of the seat 7. The steering handle 17 is connected to a steering nozzle 18 provided behind the pump nozzle 15 through a cable 19 (indicated by a dashed line in FIG. 2). When the rider rotates the handle 17 clockwise or counterclockwise, the steering nozzle 18 is swung toward the opposite direction so that the ejection direction of the water being ejected through the pump nozzle 15 can be changed, and the watercraft can be correspondingly turned to any desired direction while the water jet pump P is generating the propulsion force.

As shown in FIG. 1, a bowl-shaped reverse deflector 20 is provided on the rear side of the body 1 and on an upper portion of the steering nozzle 18 such that it can vertically swing around a horizontally mounted swinging shaft 20A. When the deflector 20 is swung downward to a lower position around the swinging shaft 20A so as to be located behind the steering nozzle 18, the water being ejected rearward from the steering nozzle 18 comes in contact with an inner surface of the deflector 20 and is ejected substantially forward. As the resulting reaction, the personal watercraft moves rearward.

The engine E and a cooling system 100 employed in the engine E will now be described with reference to FIGS. 3 to 7. As used hereinbelow, "right side" and "left side" are defined from the perspective of a rider straddling seat 7 and facing a forward side of the watercraft. As described below, the cooling system 100 has a plurality of water-drawing passages through which the water is drawn from the water jet pump P for use as cooling water to cool the engine E or the like. As shown in a partial plan view of an inside of the body 1 in FIG. 3, the engine E is placed forward of the pump casing 13, one end portion of an air-intake manifold 32 is connected to an air-intake port 31 provided on the right side of a cylinder head 30 of the engine E, and one end portion of an exhaust manifold 34 is connected to an exhaust port 33 provided on the left side of the cylinder head 30.

An upstream muffler 38 is provided on the left side of the pump casing 13. The other end portion of the exhaust manifold 34 is connected to the upstream muffler 38 through a first exhaust pipe 35, a rubber pipe 36, and a second exhaust pipe 37. A downstream muffler 40 is provided on the right side of the pump casing 13 so as to be located rearward with respect to the upstream muffler 38 in the longitudinal direction of the body 1. The upstream muffler 38 and the downstream muffler 40 communicate with each other through a first pipe 39 provided over the pump casing 13. The downstream muffler 40 communicates with an outside of the watercraft through a second pipe 41. The upstream muffler 38 and the downstream muffler 40 used herein are water mufflers. The second exhaust pipe 37 connected to the upstream muffler 38 is provided with a water-supply hole 42 through which water drops to an exhaust gas flowing within the second exhaust pipe 37.

Figure 4:
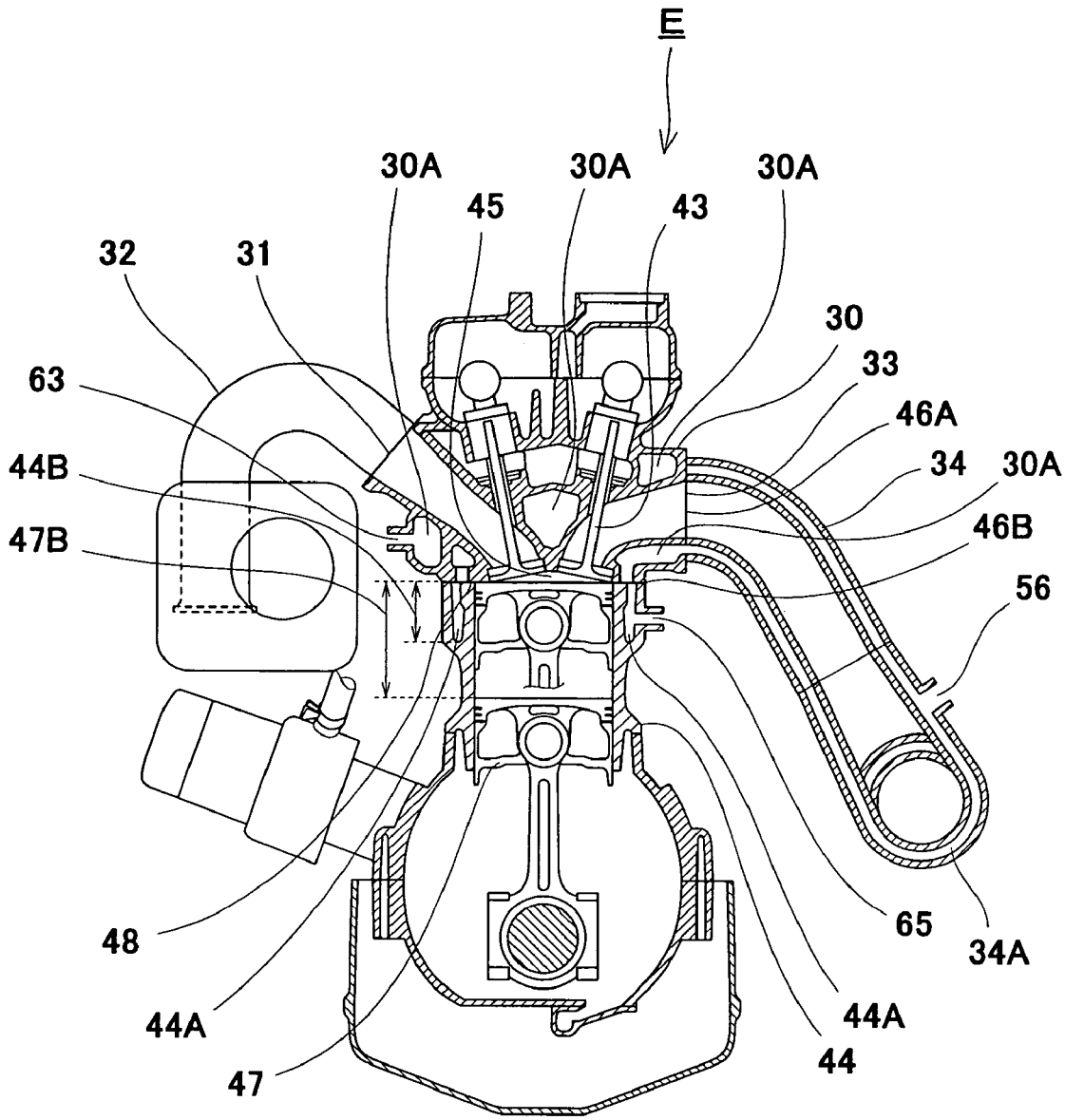
FIG. 4 is a cross-sectional view of a construction of the engine, taken along line IV—IV in FIG. 3.
Figure 5:
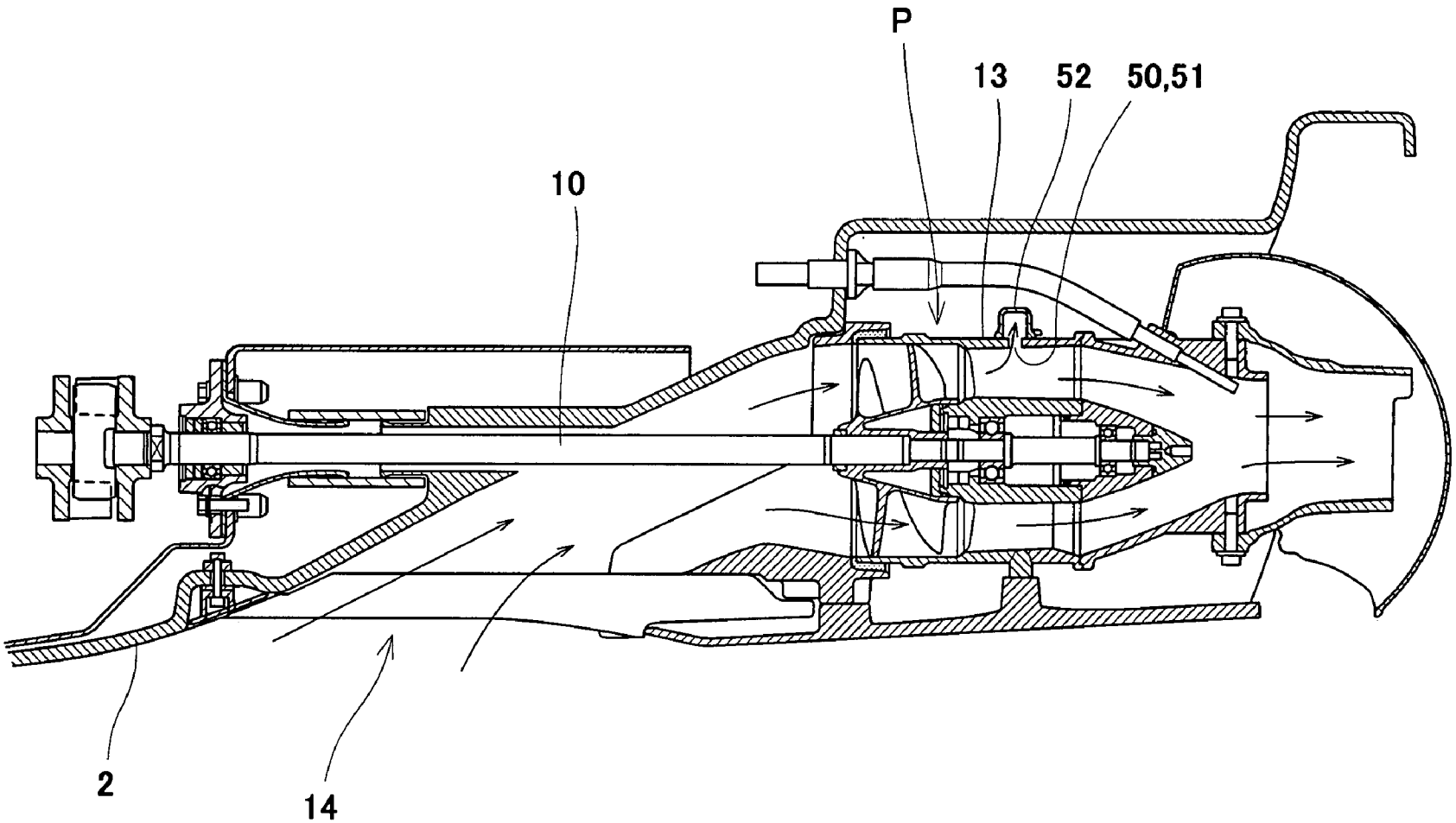
FIG. 5 is a cross-sectional view of a construction of a water jet pump, taken along line V—V in FIG. 3.

As shown in FIG. 4, the exhaust manifold 34 has a double-walled structure in which a first water jacket 34A is formed on an outer periphery of an exhaust passage to cool the exhaust manifold 34. The cooling water flowing within the first water jacket 34A cools the exhaust manifold 34, which tends to elevate in temperature due to the exhaust gas. Within the cylinder head 30, a second water jacket 30A is formed to cool the cylinder head 30. An inner space of the first water jacket 34A and an inner space of the second water jacket 30A communicate with each other at a connecting end face 46A between the cylinder head 30 and the exhaust manifold 34. The second water jacket 30A is provided in the vicinity of an exhaust valve 43 and an ignition plug (not shown) provided in the cylinder head 30, and is configured to cool the vicinity of these components that tend to heat to high temperatures.

The cylinder head 30 is fixed to a cylinder block 44 of the engine E through a head gasket 48 so that a combustion chamber 45 is formed by the cylinder head 30, the cylinder block 44, and a piston 47 inside the cylinder block 44. An upper end portion of the cylinder block 44, i.e., an end portion of the cylinder block 44 on the combustion chamber 45 side (cylinder head 30 side), has a double-walled structure in which a third water jacket 44A is formed to cool the cylinder block 44 and the piston 47 inside the cylinder block 44 so as to surround the piston 47. An inner space of the second water jacket 30A and an inner space of the third water jacket 44A communicate with each other at a connecting end face 46B between the cylinder head 30 and the cylinder block 44. The third water jacket 44A is configured such that a dimension from an upper end face of the cylinder block 44 connected to the cylinder head 30 to a lowermost end of the water jacket 44A, such that depth 44B from the upper end face of the cylinder block 44 in the direction in which the piston 47 reciprocates, is equal to or less than half of a reciprocation distance 47B of the piston 47 (the moving distance of the piston 47 between a top dead center and a bottom dead center). Also, the third water jacket 44A opens in an upper end face (the connecting end face 46B) of the cylinder block 44. In this structure, the upper end portion of the cylinder block 44, which is near to the combustion chamber 45, is sufficiently cooled, while a lower portion of the cylinder block 44, which is distant from the combustion chamber 45, is inhibited from being excessively cooled. The dimension 44B of the third water jacket 44A is suitably set in view of the amount of the cooling water and a proper temperature of the cylinder block 11.

The first exhaust pipe 35 (see FIG. 3) has a double-walled structure in which a water jacket (not shown) is formed on an outer periphery of an exhaust passage. This water jacket communicates with the first water jacket 34A provided in the exhaust manifold 34 through a hole (not shown) provided in a flange 48 (see FIG. 3) configured to connect the exhaust manifold 34 to the first exhaust pipe 35.

Figure 3:
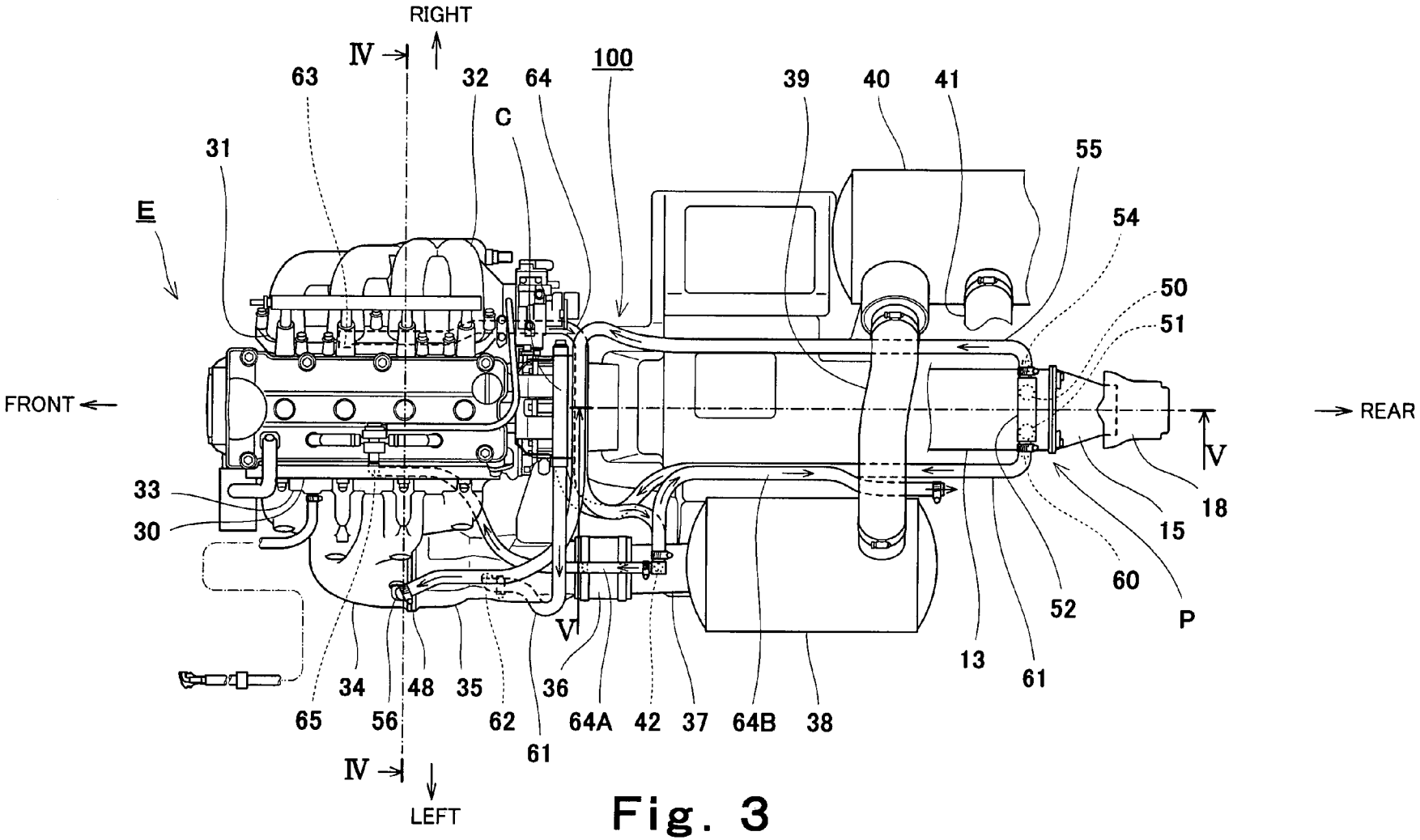
FIG. 3 is a plan view of an engine and a cooling system of the personal watercraft in FIG. 1.

As shown in FIG. 3, the pump casing 13 of the water jet pump P is provided with two water-drawing holes 50 and 51. As shown in a longitudinal sectional view of the water jet pump P in FIG. 5, the water-drawing holes 50 and 51 penetrate a wall portion of the upper portion of the pump casing 13. The water-drawing holes 50 and 51 are arranged on right and left sides (circumferential direction of the pump casing 13) so as to be located within the stable static-pressure region of the water flowing within the water jet pump P (see FIG. 3). A cover 52 is provided to cover the water-drawing holes 50 and 51.

Figure 6:
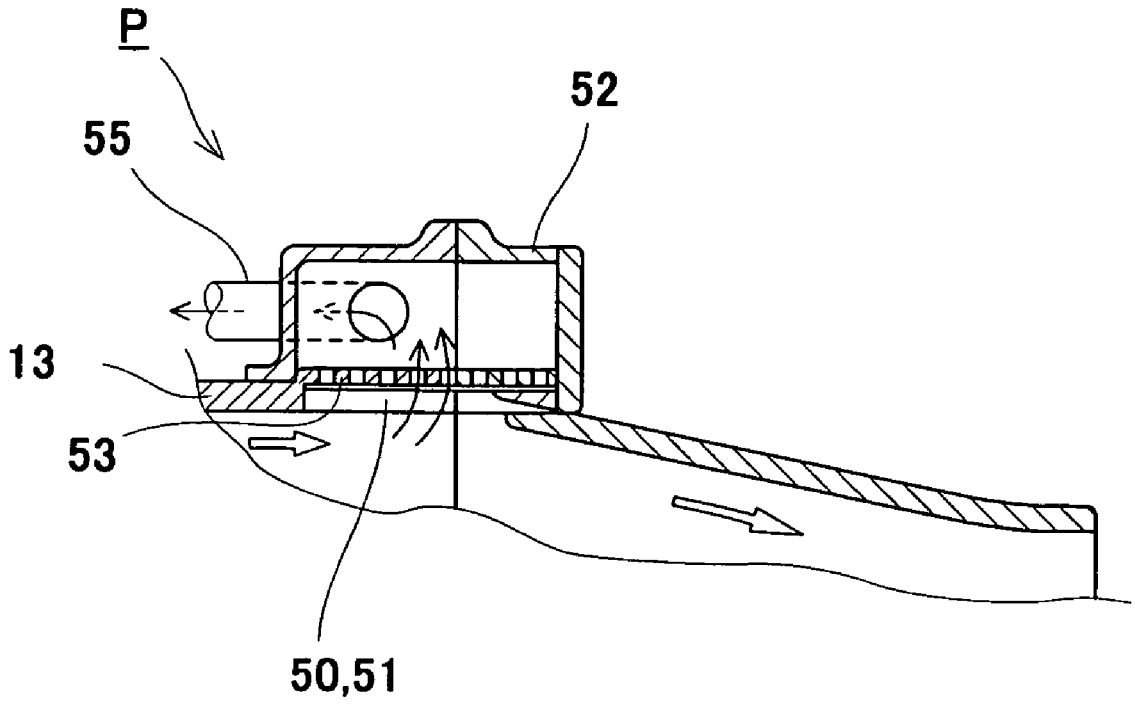
FIG. 6 is a partially enlarged cross-sectional view of structure surrounding water-drawing holes provided in a pump casing in FIG. 5.

As shown in an enlarged partial cross-sectional view of the water-drawing holes 50 and 51 and their vicinity in FIG. 6, a filter 53 is provided over the water-drawing holes 50 and 51. The filter 53 is formed by a plate member provided with slits. The cover 52 covers the water-drawing holes 50 and 51, as well as the filter 53, from above. In this structure, an inside of the water jet pump P communicates with an inside of the cover 52 through the water-drawing holes 50 and 51 and the filter 53.

As shown in FIG. 3, one end portion of a first cooling water pipe 55 is connected to a right-side portion of the cover 52 through a hollow joint 54. The first cooling water pipe 55 extends forward from the cover 52 between the downstream muffler 40 and the pump casing 13. The first cooling water pipe 55 turns its direction on a back side of the engine E and extends leftward, and the other end portion thereof is connected to a communicating hole 56 provided in the vicinity of the other end portion of the exhaust manifold 34 so as to communicate with the first water jacket 34A (FIG. 4). In this structure, the water within the water jet pump P flows into the first water jacket 34A through the water-drawing holes 50 and 51 and the first cooling water pipe 55.

One end portion of a second cooling water pipe 61 is connected to a left-side portion of the cover 52 through a hollow joint 60. The second cooling water pipe 61 extends forward from the cover 52 between the upstream muffler 38 and the pump casing 13. The other end portion of the second cooling water pipe 61 is connected to a communicating hole 62 communicating with a water jacket (not shown) formed in a wall portion of the first exhaust pipe 35. Auxiliary equipment, in this embodiment, an oil cooler C, is provided behind the engine E, and the second cooling water pipe 61 is configured to supply the cooling water to the oil cooler C at a location thereof. In this structure, the water within the water jet pump P flows into the water jacket of the first exhaust pipe 35 through the water-drawing holes 50 and 51 and the second cooling water pipe 61.

A communicating hole 63 is provided on a right-side portion of the cylinder head 30 and below the air-intake ports 31 so as to communicate with the second water jacket 30A (FIG. 4). One end portion of a third cooling water pipe 64 is connected to the communicating hole 63. The third cooling water pipe 64 extends from the right side of the cylinder head 30 to the left side of the cylinder head 30, traveling around the back side of the engine E, and is connected to the water-supply hole 42 provided in the second exhaust pipe 37.

The third cooling water pipe 64 branches into two pipes 64A and 64B at a position where the pipe 64 is connected to the water-supply hole 42. The pipe 64A is connected to a communicating hole 65 provided in the cylinder block 44 so as to communicate with the third water jacket 44A (see FIGS. 3 and 4), and the pipe 64B penetrates the hull 2 of the body 1 to outside the watercraft. In this structure, the cooling water flowing from the second water jacket 30A through the third cooling water pipe 64 is supplied to the second exhaust pipe 37 through the water-supply hole 42, or drawn to the third water jacket 44A of the cylinder block 44, and the remaining water is discharged outside the watercraft.

Figure 7:
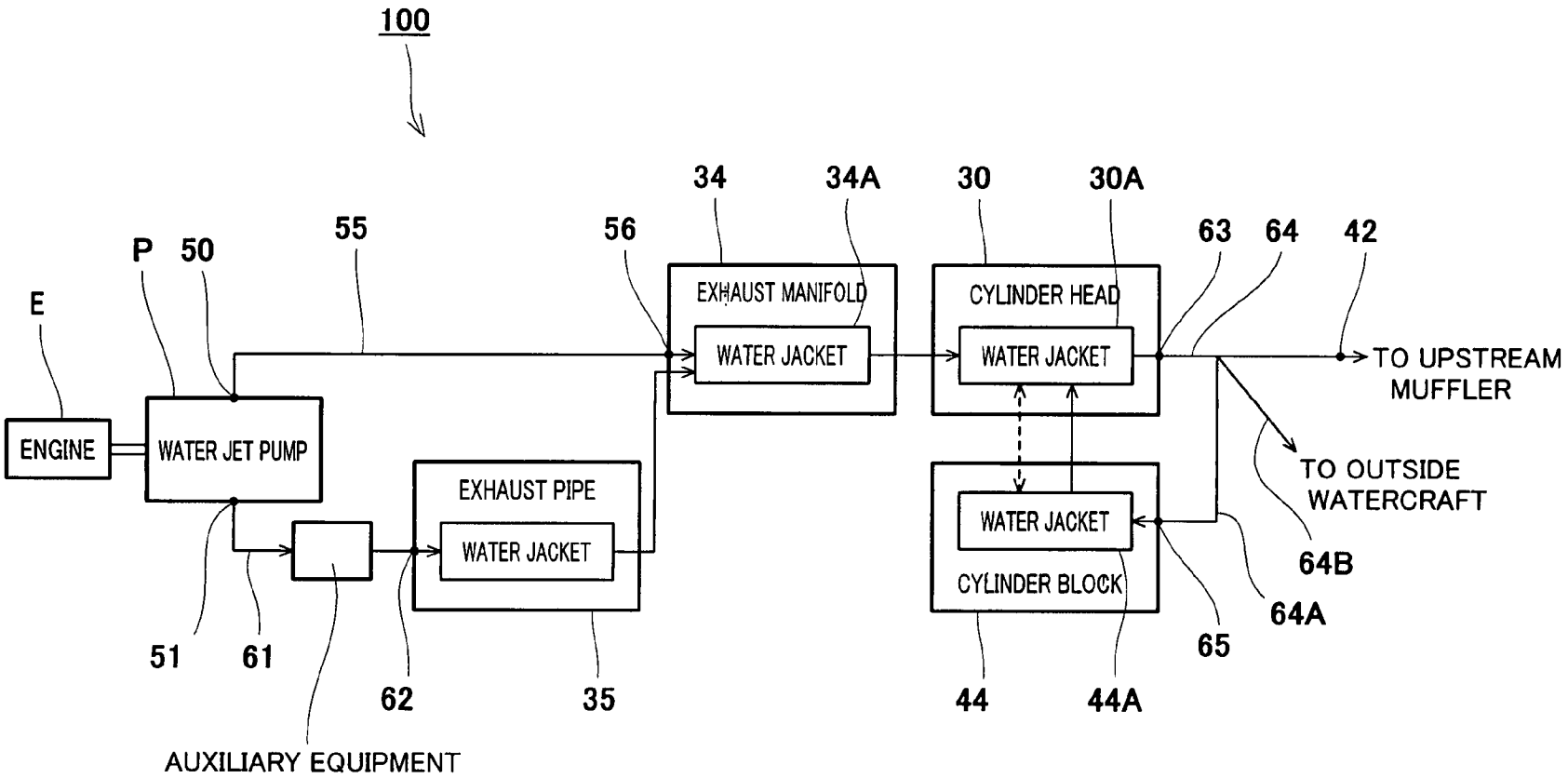
FIG. 7 is a block diagram showing water-drawing passages and a flow of cooling water in a cooling system according to an embodiment of the present invention.

FIG. 7 shows water-drawing passages and the flow of the cooling water within the above described cooling system 100. Upon the water jet pump P being driven by the engine E, the water pressurized within the water jet pump P is drawn into the first cooling water pipe 55 and the second cooling water pipe 61 through the water-drawing holes 50 and 51, respectively. While the cooling water is drawn into the first and second cooling water pipes 55 and 61, unwanted substances contained in the cooling water ate removed by the filter 53 (see FIG. 6).

The cooling water drawn into the first cooling water pipe 55 is supplied to the first water jacket 34A of the exhaust manifold 34 through the communicating hole 56 to cool the exhaust manifold 34. Meanwhile, the cooling water drawn into the second cooling water pipe 61 flows within the auxiliary equipment such as the oil cooler C while cooling the equipment. Thereafter, the cooling water flows into the water jacket of the first exhaust pipe 35 through the communicating hole 62 and cools the first exhaust pipe 35. The cooling water flowing into the water jacket of the first exhaust pipe 35 is supplied to the first water jacket 34A of the exhaust manifold 34 through the hole of the flange 48 (see FIG. 3), and is combined with the cooling water supplied to the first water jacket 34A through the first cooling water pipe 55 as described above.

The cooling water flowing within the first water jacket 34A flows into the second water jacket 30A of the cylinder head 30 through the exhaust manifold 34 (see FIG. 4) and cools the exhaust valve 43 (see FIG. 4), ignition plugs, and the like within the cylinder head 30.

The cooling water flowing within the second water jacket 30A flows within the third cooling water pipe 64 through the communicating hole 63 of the cylinder head 30. The cooling water flowing within the third cooling water pipe 64 is supplied to an exhaust gas through the water-supply hole 42 and is drawn to the upstream muffler 38, or flows into the third water jacket 44A through the pipe 64A and the communicating hole 65 and cools the cylinder block 44. As should be appreciated from the foregoing description, in the cooling system 100, the cylinder block 44 is located downstream of the cylinder head 30 and the exhaust manifold 34 in a flow direction of the cooling water. The cooling water flowing into the third water jacket 44A is combined with the cooling water flowing into the second water jacket 30A. In this embodiment, the head gasket 48 provided between the cylinder head 30 and the cylinder block 44 is provided with a through-hole (not shown) through which the second water jacket 30A of the cylinder head 30 is connected to the third water jacket 44A of the cylinder block 44. The amount of the cooling water flowing from the third water jacket 44A of the cylinder block 44 to the second water jacket 30A of the cylinder head 30 is controlled by adjusting the size of the through hole. The remaining cooling water flowing within the third cooling pipe 64 is discharged outside the watercraft through the pipe 64B. As indicated by a broken line in FIG. 7, the cooling water may partially flow between the second water jacket 30A of the cylinder head 30 and the third water jacket 44A of the cylinder block 44.

In the personal watercraft constructed as described above, the diameter of each of the water-drawing holes 50 and 51 provided in the water jet pump P is smaller than the required diameter of one water-drawing hole configured to draw the same amount of water. Therefore, the water-drawing holes 50 and 51 are suitably positioned in a narrow region of the water jet pump P where the static-pressure is relatively stable. Thereby, the cooling water is efficiently drawn up through the water-drawing holes 50 and 51. The number and diameter of the water-drawing holes are suitably determined depending on the static-pressure region of the water jet pump P and the amount of water to be drawn up.

The cooling water supplied from the first cooling water pipe 55 first cools the exhaust manifold 34 and the cylinder head 30, and thereafter cools the cylinder block 44. According to this construction, the exhaust manifold 34 and the cylinder head 30 whose temperatures become relatively high are sufficiently cooled, and the cylinder block 44 is inhibited from being excessively cooled. As a result, the occurrence of friction loss and the dilution of oil can be inhibited.

The cooling water supplied from the second cooling water pipe 61 cools the auxiliary equipment such as the oil cooler, and thereafter cools the exhaust pipe 35, the exhaust manifold 34, the cylinder head 30, and the cylinder block 44 in successive order. Therefore, in a personal watercraft equipped with auxiliary equipment that is required to be cooled by cooling water of a relatively low temperature, the low-temperature cooling water is first supplied to the auxiliary equipment through the second cooling water pipe 61, which is different from the first cooling water pipe 55 through which the cooling water is first supplied to the exhaust manifold 34.

Since the cooling system 100 has a plurality of cooling water-drawing passages comprised of the water-drawing holes 50 and 51, and the first and second cooling water pipes 55 and 61, the water can be drawn for use as the cooling water to cool the engine E through the second cooling water pipe 61 if the first cooling water pipe 55 is clogged with unwanted substances.

As this invention may be embodied in several forms without departing from the spirit of essential characteristics thereof, the above embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An engine for a personal watercraft, comprising:

an open-looped cooling system configured to take in water from outside the watercraft, for use as cooling water to cool the engine and thereafter discharge the cooling water outside the watercraft;

a cylinder block having a water jacket formed inside thereof, the water jacket being coupled to the open looped cooling system such that the cooling water flows through the water jacket;

a cylinder head connected to an upper end face of the cylinder block so as to form a combustion chamber; and a piston that reciprocates within cylinder block;

wherein the water jacket is provided in an uppermost end portion of the cylinder block so as to surround the piston, the water jacket being formed so as to open into the upper end face of the cylinder block facing the cylinder head; and wherein the water jacket extends downward from the upper end face of the cylinder block, and a dimension of the water jacket from the upper end face of the cylinder block to a lowermost portion of the water jacket in a reciprocation direction of the piston is equal to or less than a half of a reciprocation distance of the piston so that excess cooling of the cylinder block is inhibited.

2. The engine for a personal watercraft according to claim 1, wherein the piston is configured to reciprocate according to a four stroke cycle.

3. The personal watercraft according to claim 1, wherein the cylinder block includes a non-removable wall surrounding a chamber within which the piston reciprocates, the wall being formed intermediate the water jacket and the chamber.

4. A personal watercraft comprising:

a water jet pump configured to propel the watercraft;

an engine configured to drive the water jet pump; and a cooling system configured to cool the engine with water;

wherein the cooling system has at least two water-drawing passages through which the water is drawn from an inside of the water jet pump for use as cooling water; and wherein at least one of the water drawing passages is configured to extend from the water jet pump to the engine through an auxiliary device.

5. The personal watercraft according to claim 4, wherein a plurality of water-drawing holes of the water-drawing passages are circumferentially arranged on an outer periphery of the water jet pump.

6. The personal watercraft according to claim 5, wherein the water jet pump is provided with a pump casing which contains fairing vanes, and the water drawing holes are configured to penetrate a wall portion of the pump casing above the fairing vanes.

7. The personal watercraft according to claim 4, wherein the engine comprises a cylinder block having a water jacket within which the cooling water flows, and a piston that reciprocates within the cylinder block, wherein a dimension of the water jacket in a reciprocation direction of the piston is equal to or less than a half of a reciprocation distance of the piston.

8. The personal watercraft according to claim 7, further comprising:

a cylinder head provided on the cylinder block and configured to form a combustion chamber;

wherein the cylinder block and the cylinder head are configured to be cooled by cooling water, and the cylinder block is placed downstream of the cylinder head in a flow direction of the cooling water in the cooling system.

9. The personal watercraft according to claim 4, further comprising:

an exhaust device of the engine which is configured to be cooled by the cooling water, wherein the engine has a cylinder block configured to be cooled by the cooling water, and the cylinder block is placed downstream of the exhaust device in a flow direction of the cooling water in the cooling system.

10. A personal watercraft comprising:

a water jet pump configured to propel the watercraft;

an engine configured to drive the water jet pump; and a cooling system configured to cool the engine with water;

wherein the cooling system has at least two water drawing passages through which the water is drawn from an inside of the water jet pump for use as cooling water, and wherein a plurality of water drawing holes of the water drawing passages are circumferentially arranged on an outer periphery of the water jet pump.

11. An engine for a personal watercraft having an open-looped cooling system configured to take in water from outside the watercraft, for use as cooling water to cool the engine and thereafter discharge the cooling water outside the watercraft, the engine comprising:

a cylinder block having a water jacket within which the cooling water flows;

a piston that reciprocates within the cylinder block, wherein a dimension of the water jacket in a reciprocation direction of the piston is equal to or less than a half of a reciprocation distance of the piston; and a cylinder head provided on the cylinder block and configured to form a combustion chamber;

wherein the cylinder block and the cylinder head are configured to be cooled by cooling water, and the cylinder block is placed downstream of the cylinder head in a flow direction of the cooling water in the cooling system.

12. The engine for a personal watercraft according to claim 11, further comprising:

a cylinder head provided on the cylinder block and configured to form a combustion chamber;

wherein the water jacket is provided in an end portion of the cylinder block on the cylinder head side so as to surround the piston.

13. The engine for a personal watercraft according to claim 12, wherein the water jacket is configured to open in an end face of the cylinder block on the cylinder head side.

14. The engine for a personal watercraft according to claim 11, wherein the piston is configured to reciprocate according to a four stroke cycle.

15. A personal watercraft comprising:

a water jet pump configured to propel the watercraft;

an engine configured to drive the water jet pump; and a cooling system configured to cool the engine with water;

wherein the cooling system has at least two water drawing passages through which the water is drawn from an inside of the water jet pump for use as cooling water; and wherein the engine comprises a cylinder block and a cylinder head configured to be cooled by the cooling water, and the cylinder block is placed downstream of the cylinder head in a flow direction of the cooling water in the cooling system.

16. The personal watercraft according to claim 15, wherein a plurality of water drawing holes of the water drawing passages are circumferentially arranged on an outer periphery of the water jet pump.

17. The personal watercraft according to claim 15, wherein the engine comprises a cylinder block having a water jacket within which the cooling water flows, and a piston that reciprocates within the cylinder block;

wherein a dimension of the water jacket in a reciprocation direction of the piston is equal to or less than a half of a reciprocation distance of the piston.

18. The personal watercraft according to claim 15, further comprising:

an exhaust device of the engine which is configured to be cooled by the cooling water, wherein the engine has a cylinder block configured to be cooled by the cooling water, and the cylinder block is placed downstream of the exhaust device in a flow direction of the cooling water in the cooling system.

* * * * *